US007163593B2

(12) United States Patent
Sugawara et al.

(10) Patent No.: US 7,163,593 B2
(45) Date of Patent: Jan. 16, 2007

(54) IRON-BASED ALLOY AND METHOD FOR PRODUCTION THEREOF

(75) Inventors: Takeshi Sugawara, Wako (JP); Noriyuki Yamada, Wako (JP); Makoto Asami, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/311,311

(22) PCT Filed: Apr. 19, 2002

(86) PCT No.: PCT/JP02/03962

§ 371 (c)(1),
(2), (4) Date: Dec. 27, 2002

(87) PCT Pub. No.: WO02/088409

PCT Pub. Date: Nov. 7, 2002

(65) Prior Publication Data

US 2003/0127164 A1 Jul. 10, 2003

(30) Foreign Application Priority Data

Apr. 27, 2001 (JP) ..... 2001-131212

(51) Int. Cl.
*C22C 38/12* (2006.01)
*C22D 38/08* (2006.01)
*C21D 6/02* (2006.01)

(52) U.S. Cl. ..... 148/321; 148/612; 148/324

(58) Field of Classification Search ..... 420/12; 148/321, 663, 664, 654, 545
See application file for complete search history.

(56) References Cited

U.S. PATENT DOCUMENTS

| | | | | |
|---|---|---|---|---|
| 2,662,010 | A | 12/1953 | Ahles | |
| 5,063,116 | A * | 11/1991 | Uchida | 428/606 |
| 5,674,449 | A * | 10/1997 | Liang et al. | 420/12 |

FOREIGN PATENT DOCUMENTS

| | | |
|---|---|---|
| CS | 186472 B | 12/1978 |
| JP | 0 630 984 A1 | 12/1994 |
| JP | 2978384 | 9/1999 |
| JP | 11-342407 | 12/1999 |
| JP | 2000-051912 | 2/2000 |
| WO | 95/24513 A | 9/1995 |

* cited by examiner

*Primary Examiner*—Roy King
*Assistant Examiner*—Kathleen McNelis
(74) *Attorney, Agent, or Firm*—Arent Fox PLLC

(57) ABSTRACT

An iron-based alloy comprises 1.5 to 2.5 wt % of C, 0.25 to 4.75 wt % of Ni, and W and V in quantities surrounded by the line L as shown in FIG. 1 of the attached drawings with a balance of Fe and inevitable impurities. The iron-based alloy is obtained by a first heat treatment for applying a solid solution treatment by rapidly cooling the iron-based alloy from a temperature of an austenite forming temperature or more to consequently obtain a mixed matrix comprising a base matrix of martensite and remaining austenite phases and a non-molten carbide, and a second heat treatment for cooling the iron-based alloy after precipitating an MC type carbide within an eutectoid transformation temperature range to consequently precipitate a low carbon content austenite phase.

3 Claims, 2 Drawing Sheets

IRON-BASED ALLOY AND METHOD FOR PRODUCTION THEREOF

TECHNICAL FIELD

The present invention relates to an iron-based alloy that exhibits a high Young's modulus in an attempt to improve rigidity, and is suitable for making articles which are lightweight and compact, and relates to a method for producing the same.

BACKGROUND ART

So-called iron-based alloys such as iron alloys and steels mainly comprising iron have been most extensively used as various structural metallic materials. Since materials are currently required to be lightweight and compact in all industrial fields, the structural metallic materials are also required to satisfy such demands. While attempts have been made to have the materials have high strength to meet recent technical requirements, materials merely having a high strength are likely to be insufficient in their rigidity, and some mechanical parts are barely made lightweight and compact.

These materials may be replaced with light metals for making the materials light weight. However, when the iron-based alloy is replaced with light weight alloys such as an aluminum alloy or magnesium alloy, frames and structures will be large due to the insufficient strength of the materials, failing to yield compact structures. Alternatively, the structure may be made lightweight using ceramics. However, ceramics are not suitable for structural materials due to their poor toughness in addition to their high cost. Alternatively, iron and steel materials having a high Young's modulus have also been studied by adding reinforcing particles such as ceramic particles to iron.

However, the reinforcing particles are not perfectly adhered to the iron base in the method for adding the reinforce particles. In addition, a theoretical level of the Young's modulus cannot be attained since the reinforcing particles tend to segregate at crystal grain boundaries while causing decrease of toughness because the reinforcing particles aggregated by themselves as the amount of addition of the particles is increased. Therefore, the mechanical strength of the iron-based material can hardly be compatible with fatigue strength. Since high deformation resistance due to the presence of the reinforcing particles as well as decrease of ductility due to segregation of the reinforcing particles at the crystal grain boundaries make plastic machining such as rolling difficult, it is difficult to increase toughness by plastic machining for making γ-phase grains fine. While a martensite phase has been a representative matrix of conventional high strength materials serves to increase toughness by tempering, the iron-based material cannot be expected to have a high Young's modulus as a result of dispersion of $Fe_3C$ (cementite) phases because the material inherently contains little carbon (C), and a large proportion of the carbon, if any, in the material, forms a solid solution in iron to decrease the proportion of the $Fe_3C$ (cementite) phase.

Accordingly, it is an object of the present invention to provide an iron-based alloy and a method for producing the same, wherein mechanical characteristics such as a Young's modulus, toughness and strength are maintained at high levels without adding any reinforcing particles, besides suppressing its specific gravity from being elevated while maintaining these characteristics, resulting in light weight and compactness of the material.

DISCLOSURE OF INVENTION

The inventors of the present invention have found, through intensive research of means for improving the Young's modulus instead of adding the reinforce particles, that the object of the present invention can be attained by prescribing the content of specified elements while forming a fine MC type carbide that contributes to improve the Young's modulus to form in the base matrix by applying an appropriate heat treatment. The MC type carbide refers to a metal-carbon (C) based carbide with an atomic ratio between the metal and carbon of 1:1. The present invention is made based on the findings above, provides an iron-based alloy comprising: 1.5 to 2.5 wt % of C; 0.25 to 4.75 wt % of Ni; W and V in quantities corresponding to a region surrounded by a line L as shown in FIG. 1 of attached drawings; a balance of Fe; inevitable impurities; and an MC type carbide included in a matrix. The MC type carbide as used herein comprises a combination of crystallization type V carbide (VC) and a precipitation type W carbide (WC) formed by bonding V and W to C.

FIG. 2 illustrates the matrix of the iron-based alloy according to the present invention. As shown in the drawing, the MC type carbide (MC) having a high Young's modulus such as WC and VC are distributed in the base matrix comprising a martensite (M) phase having a high strength and toughness and an austenite (γ) phase having high toughness.

The iron-based alloy according to the present invention may contain 0.25 to 1.7 wt % of Mn. Mn serves to improve deoxidation effects and cutting performance while contributing to forming the γ phase.

The iron-based alloy according to the present invention may also contain at least one of 0.3 wt % or less of Ti, 0.6 wt % or less of Nb, 10 wt % or less of Mo, 15 wt % or less of Cr and 0.005 wt % or less of B. Ti and Nb are elements used for forming carbides, and Mo, Cr and B are elements that serve to reinforce the iron-based alloy.

The present invention also provides a method for producing an iron-based alloy comprising: a first heat treatment for applying a solid solution treatment by rapidly cooling the iron-based alloy from a temperature of an austenite forming temperature or more to consequently obtain a mixed matrix comprising a base matrix of martensite and remaining austenite phases and a non-molten carbide; and a second heat treatment for cooling the iron-based alloy after precipitating an MC type carbide within an eutectoid transformation temperature range to consequently precipitate a low carbon content austenite phase, wherein the iron-based alloy comprises: 1.5 to 2.5 wt % of C; 0.25 to 4.75 wt % of Ni; W and V in quantities corresponding to a region surrounded by a line L as shown in FIG. 1 of attached drawings; a balance of Fe; inevitable impurities; and an MC type carbide included in a matrix.

In the producing method according to the present invention, a starting material of the iron-based alloy having the foregoing composition is obtained by means of melt-casting. W and V are present as WC and $W_2C$, and VC and $V_2C$, respectively. Then, after applying a forming process such as plastic working, if necessary, the material is heated to a temperature of 900° C. or more where the W based carbide is completely subjected to a solid solution, or preferably to a temperature of 1000° C. or more where the V based carbide is preferentially subjected to a solid solution, and is maintained at that temperature in a first heat treatment, followed by rapid cooling. The solvent for the rapid cooling may be water if sufficient volume of the water for the rapid cooling for the material. If quenching cracks are formed by rapid cooling with water, oil quenching or salt-bath quenching may be used. The matrix obtained by the first heat treatment is a mixed matrix of a base matrix comprising a martensite phase and a remaining austenite phase (γ phase), and a non-molten carbide mainly comprising a portion of the V based carbide which is not subjected to a solid solution.

In a second heat treatment, the material obtained in the first heat treatment is tempered to form the MC type carbide and precipitate a γ phase. The material is tempered by maintaining it at an eutectoid transformation temperature (A1 transformation temperature) for a predetermined time, and is then cooled. The eutectoid transformation temperature can have a temperature range in which uneven temperature in running operations can be allowed by containing 0.5 to 2.5 wt % of Ni in the material. Since an area where a ferrite phase, austenite phase and carbide exist together is formed with the temperature range, the martensite phase is transformed into a tempered martensite phase and austenite phase by maintaining the material at the temperature range for a predetermined period of time. Supersaturated V and W precipitate as carbides as a result of this transformation. While W of these carbides precipitates as WC at the initial stage, V precipitates as $V_2C$ first, and gradually changes to $V_8C_7$ (which is approximately VC) with supply of carbon generated by decomposition of the martensite phase as a function of time. When the retention time is too short, the VC carbide is insufficiently changed into the MC type carbide. When the retention time is too long, the $V_8C_7$ and the WC return to the $V_2C$ or the $W_2C$ because the tempered martensite phase transforms into the austenite phase, in which carbon is subjected to a solid solution. The MC type carbide is obtainable when the retention time is in a range of 30 to 120 minutes. The retention time is preferably in a range of 45 to 105 minutes since the amount of the MC type carbide reaches its maximum.

Tempering is performed at the eutectoid transformation temperature because growth of the MC type carbide takes a long time at a temperature below the eutectoid transformation temperature, while when the temperature exceeds the eutectoid transformation temperature, the martensite phase rapidly transforms into the austenite phase, thereby failing in obtaining the MC type carbide to consequently decrease the Young's modulus and strength.

In the cooling after maintaining the temperature, the ferrite phase transforms into the austenite phase at a temperature below the A1 transformation point by containing 0.5 to 2.5 wt % of Ni. The austenite phase thus formed contributes to high toughness and ductility because it contains a small amount of carbon in the solid solution. Control of running operation would be easy by expanding the eutectoid transformation temperature range when the material contains 0.25 to 1.7 wt % of Mn in addition to Ni. Mn also has an effect to help forming the austenite phase during the cooling after the precipitation treatment.

The MC type carbide is distributed in the base matrix comprising the tempered martensite phase and low carbon content austenite phase in the matrix of the material obtained by the first and second heat treatment. Consequently, the material exhibits a high Young's modulus and excellent toughness.

The Young's modulus is progressively improved as the content of the MC type carbide in the iron-based alloy according to the present invention is increased. However, an appropriate amount of the MC type carbide should be determined to satisfy a favorable balance among the conditions such as toughness, ductility, machinability and cost, because the material becomes a ceramic when the volume ratio of the MC type carbide is 100%. While the upper limit of the volume ratio of the MC type carbide is conjectured to be 32% in consideration of mechanical characteristics such as toughness and ductility, the upper limit of the volume ratio is 25% from the view point of cost. The lower limit of the content should be 17% or more to improve the Young's modulus.

While a higher content of the WC is advantageous for obtaining a higher Young's modulus by increasing the specific gravity of the MC type carbide, the higher specific gravity is disadvantageous for making the material lightweight. Accordingly, a specific gravity equal to or lower than the specific gravity of the base steel may be obtained by containing WC and VC together.

The base matrix of the iron-based alloy obtained in the present invention is preferably a hypoeutectoid phase that contains a low concentration of carbon. However, the basic composition of the iron-based alloy according to the present invention has a relatively higher carbon content, suggesting that it usually assumes a hypereutectoid matrix. Generally, toughness and ductility of a carbon steel decrease as the content of carbon increases due to precipitation of a network of the carbide. Therefore, the carbon content of the base matrix is decreased by forming the carbide at a temperature higher than the eutectoid temperature, in order to form a hypoeutectoid base matrix containing a low concentration of carbon. Adding an element that is more active than Fe and forms a carbide having a higher Young's modulus is effective for the purpose above, and the elements suitable for this purpose include V, W, Ti, Nb, Mo and B. The carbon content of the base matrix becomes lower than the eutectoid concentration, or the base matrix becomes a hypoeutectoid phase, by forming carbides of the elements above at the initial stage of crystallization when the material solidifies from its molten state or at the initial stage of precipitation. Toughness and ductility of the material are more improved when the configuration of the carbide is flake-shaped rather than a network, or spherical rather than flake-shaped. The hypoeutectoid phase of the base matrix is preferable because the carbide in the hypoeutectoid phase readily assumes a spherical shape.

The reason why the content of each element contained in the iron-based alloy according to the present invention is restricted will be described hereinafter.

C: 1.5 to 2.5 wt %

C is an essential element for forming a carbide together with V and W. A definite effect for improving the Young's modulus cannot be obtained due to deficiency of the carbide when the content of C is less than 1.5 wt %. When the content of C exceeds 2.5 wt %, on the other hand, toughness is remarkably decreased due to excess content of the carbide. Accordingly, the content of C is restricted to within the range of 1.5 to 2.5 wt %.

W and V: The Amount Indicated By the Area Surrounded By the Line L in FIG. 1

The amount of the carbides other than the MC type carbide is restricted while restricting the volume ratio of the MC type carbide within the range of 17 to 32%, when the contents of W and C are restricted within this area. In addition, the specific gravity of the material is restricted to be below 8.3 that is an upper limit of the specific gravity of generally used steel materials (heat resistant materials). The object of the present invention is to attain these values with respect to the volume ratio and specific gravity.

Ni: 0.25 to 4.75 wt %

Ni permits the eutectoid transformation temperature to have a temperature range in which uneven temperature during running operation can be allowed in the second heat treatment according to the present invention, and allows the MC type carbide to be formed in that range. Ni also makes an austenite phase to be formed from a ferrite phase in the cooling after retention of the temperature, thereby improving rigidity, strength, and toughness of the material. However, the effects above cannot be obtained when the Ni content is less than 0.25 wt %. When the Ni content exceeds 4.75 wt %, on the other hand, strength and toughness decrease due to appearance of a high carbon content austenite phase containing a lot of C in the final matrix. Accordingly, the content of Ni is restricted within the range of 0.25 to 4.75 wt %.

Mn: 0.25 to 1.7 wt %

Addition of Mn is unavoidable because it has a deoxidation effect. Furthermore, Mn contributes to improving cutting performance by forming a compound with S. Adding Mn together with Ni permits the eutectoid transformation temperature to expand the temperature range in which uneven temperature during running operation can be allowed in the second heat treatment according to the present invention, thereby facilitating the formation of the MC type carbide within the temperature range. Mn also helps the austenite phase to be formed in the cooling after maintaining the temperature. The effect in the second heat treatment according to the present invention obtainable by adding Mn and Ni together cannot be obtained when the content of Mn is less than 0.25 wt %. When the Mn content exceeds 1.7 wt %, on the other hand, strength and toughness of the material are decreased since the high carbon austenite phase containing a lot of C appears in the final matrix. Accordingly, the content of Mn is restricted within the range of 0.25 to 1.7 wt %.

Ti: 0.3 wt % or less

Ti is effective as an element for forming a carbide that is formed during crystallization and precipitation. The Ti carbide is liable to from a double carbide by forming a solid solution with W and V. Accordingly, the content of Ti is restricted to be less than 0.3 wt %.

Nb: 0.6 wt % or less

Nb is also effective as an element for forming a carbide that is formed during crystallization and precipitation. The Nb carbide (NbC) is a little inferior in relative rigidity to the VC carbide, and is effective for reinforcing the base material rather than improving the Young's modulus. The content of Nb is therefore restricted to be less than 0.6 wt % considering the above situation.

Mo: 10 wt % or less

The amount of addition of Mo is comparable to that in tool steels, and the maximum amount thereof is 10 wt %. A content of 0.7 wt % or less is desirable when the material is used for structural steels.

Cr: 15 wt % or less

The amount of addition of Cr is comparable to that in tool steels, and the maximum amount thereof is 15 wt %. A content of 3.5 wt % or less is desirable when the material is used for structural steels.

B: 0.005 wt % or less

The amount of addition of B is comparable to that in boron steels, and the maximum amount thereof is 0.005 wt %.

BEST MODE FOR CARRYING OUT THE INVENTION

Figure 1:
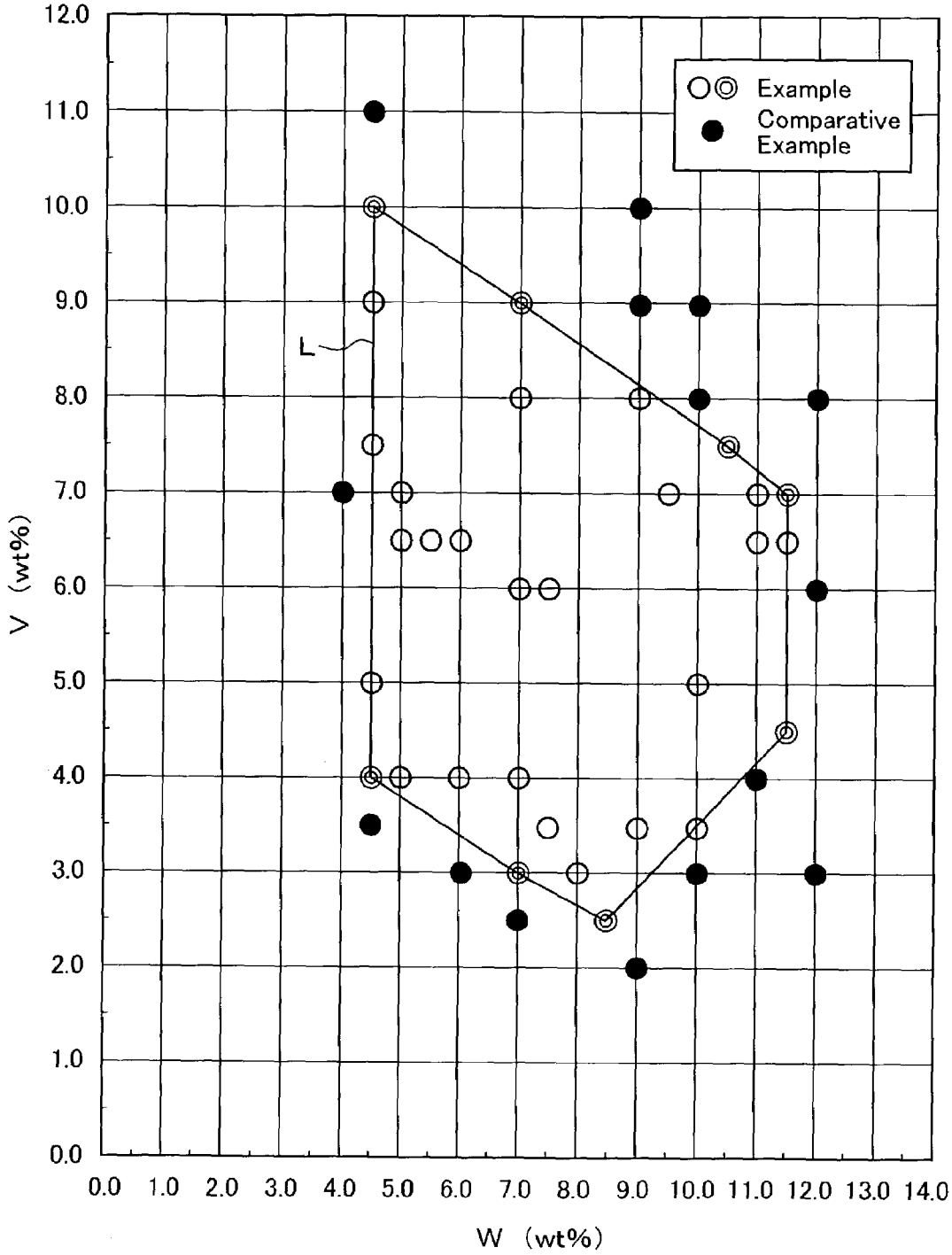
FIG. 1 is a graph showing the relationships between the W content and V content in the iron-based alloys in the examples according to the present invention and in the comparative examples.
Figure 2:
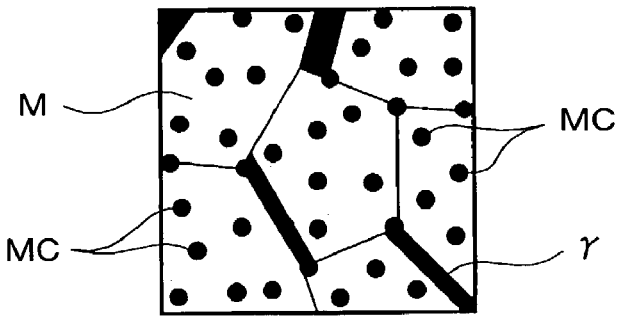
FIG. 2 illustrates the metallic matrix of the iron-based alloy according to the present invention.

The embodiments of the present invention will be described hereinafter.

(1) EXAMPLES FOR DETERMINING THE OPTIMUM RANGE OF V AND W

The iron-based alloys of the examples in the present invention and comparative examples were manufactured as described below, and the range of the optimum content of V and W for attaining the object of the present invention were confirmed by determining the volume ratio and specific gravity of carbides thereof.

Examples 1 to 32

The iron-based alloys with the compositions of Examples 1 to 32 shown in Table 1 were prepared by melting 100 kg each of the raw material, and rod-shaped samples with a diameter of 20 mm were obtained after subjecting each material to casting and hot-rolling. The samples in Examples 1 to 32 were subjected to the first heat treatment in which each sample was cooled with water after holding it at 1100° C. Subsequently, the second heat treatment was applied after heating each sample to 640° C. for 1 hour.

TABLE 1

| | C wt % | W wt % | V wt % | VC % | WC % | $M_6C$ % | Vf % | SPECIFIC GRAVITY |
|---|---|---|---|---|---|---|---|---|
| EXAMPLE 1 | 1.6 | 4.5 | 5.0 | 16 | 4 | 0 | 20 | 7.74 |
| EXAMPLE 2 | 2.5 | 4.5 | 10.0 | 28 | 4 | 0 | 32 | 7.45 |
| EXAMPLE 3 | 2.5 | 7.0 | 9.0 | 26 | 6 | 0 | 32 | 7.64 |
| EXAMPLE 4 | 2.5 | 10.5 | 7.5 | 22 | 10 | 0 | 32 | 8.03 |
| EXAMPLE 5 | 2.5 | 11.5 | 7.0 | 21 | 11 | 0 | 32 | 8.12 |
| EXAMPLE 6 | 2.5 | 11.5 | 6.5 | 21 | 11 | 0 | 32 | 8.12 |
| EXAMPLE 7 | 2.5 | 11.5 | 4.5 | 14 | 11 | 0 | 25 | 8.29 |
| EXAMPLE 8 | 2.5 | 10.0 | 3.5 | 11 | 10 | 0 | 21 | 8.29 |
| EXAMPLE 9 | 2.0 | 8.5 | 2.5 | 8 | 9 | 0 | 17 | 8.29 |

TABLE 1-continued

| | C wt % | W wt % | V wt % | VC % | WC % | $M_6C$ % | Vf % | SPECIFIC GRAVITY |
|---|---|---|---|---|---|---|---|---|
| EXAMPLE 10 | 2.0 | 7.0 | 3.0 | 10 | 7 | 0 | 17 | 8.11 |
| EXAMPLE 11 | 2.0 | 4.5 | 4.0 | 13 | 4 | 0 | 17 | 7.82 |
| EXAMPLE 12 | 1.6 | 4.5 | 5.0 | 16 | 4 | 0 | 20 | 7.74 |
| EXAMPLE 13 | 1.6 | 7.0 | 4.0 | 13 | 7 | 0 | 20 | 8.03 |
| EXAMPLE 14 | 1.6 | 8.0 | 3.0 | 10 | 8 | 0 | 18 | 8.18 |
| EXAMPLE 15 | 1.6 | 7.5 | 3.5 | 11 | 8 | 0 | 19 | 8.15 |
| EXAMPLE 16 | 2.5 | 11.0 | 7.0 | 21 | 10 | 0 | 31 | 8.05 |
| EXAMPLE 17 | 2.0 | 4.5 | 7.5 | 22 | 4 | 0 | 26 | 7.52 |
| EXAMPLE 18 | 2.5 | 4.5 | 9.0 | 26 | 4 | 0 | 30 | 7.52 |
| EXAMPLE 19 | 1.5 | 6.0 | 4.0 | 13 | 6 | 0 | 19 | 7.97 |
| EXAMPLE 20 | 2.5 | 9.0 | 8.0 | 24 | 8 | 0 | 32 | 8.01 |
| EXAMPLE 21 | 2.0 | 5.0 | 4.0 | 13 | 5 | 0 | 18 | 7.89 |
| EXAMPLE 22 | 2.0 | 5.0 | 7.0 | 21 | 5 | 0 | 26 | 7.72 |
| EXAMPLE 23 | 2.0 | 6.0 | 6.5 | 20 | 6 | 0 | 26 | 7.80 |
| EXAMPLE 24 | 2.0 | 7.5 | 6.0 | 18.5 | 7.2 | 0 | 26 | 7.92 |
| EXAMPLE 25 | 2.0 | 5.0 | 6.5 | 19 | 4.6 | 0 | 24 | 7.72 |
| EXAMPLE 26 | 2.0 | 5.5 | 6.5 | 19.8 | 5.3 | 0 | 25 | 7.75 |
| EXAMPLE 27 | 2.0 | 7.0 | 6.0 | 18.6 | 6.7 | 0 | 25 | 7.88 |
| EXAMPLE 28 | 2.0 | 10.0 | 5.0 | 15.7 | 9.7 | 0 | 25 | 8.17 |
| EXAMPLE 29 | 2.5 | 7.0 | 8.0 | 23.6 | 6.4 | 0 | 30 | 7.74 |
| EXAMPLE 30 | 2.5 | 9.5 | 7.0 | 21 | 9 | 0 | 30 | 7.99 |
| EXAMPLE 31 | 2.5 | 11.0 | 6.5 | 19.7 | 10.4 | 0 | 30 | 8.12 |
| EXAMPLE 32 | 2.0 | 9.0 | 3.5 | 8.9 | 11.2 | 0 | 20 | 8.22 |

Comparative Examples 1 to 15

Samples comprising the iron-based alloys having the compositions in Comparative Examples 1 to 15 shown in Table 2 were obtained by the same method as that used for the Examples, and these samples were heat treated as in the Examples.

Examples 1 to 15. The area surrounded by the line L in the graph corresponds to the combination between the W content and V content prescribed in the present invention.

The volume ratio of the carbide VC(%), WC(%) and $M_6C$(%), Vf(%) as a sum of these ratios, and specific gravity were determined for each sample of the Examples and the Comparative Examples. The results are listed in Tables 1 and

TABLE 2

| | C wt % | W wt % | V wt % | VC % | WC % | $M_6C$ % | Vf % | SPECIFIC GRAVITY |
|---|---|---|---|---|---|---|---|---|
| COMPARATIVE EXAMPLE 1 | 1.6 | 4.0 | 7.0 | 19 | 1 | 12 | 32 | 8.01 |
| COMPARATIVE EXAMPLE 2 | 2.5 | 9.0 | 10.0 | 25 | 4 | 16 | 44 | 7.60 |
| COMPARATIVE EXAMPLE 3 | 2.5 | 10.0 | 9.0 | 25 | 8 | 5 | 37 | 8.09 |
| COMPARATIVE EXAMPLE 4 | 2.5 | 4.5 | 11.0 | 28 | 1 | 10 | 39 | 7.70 |
| COMPARATIVE EXAMPLE 5 | 2.5 | 9.0 | 9.0 | 25 | 8 | 0 | 33 | 7.70 |
| COMPARATIVE EXAMPLE 6 | 2.5 | 10.0 | 8.0 | 24 | 9 | 0 | 33 | 7.87 |
| COMPARATIVE EXAMPLE 7 | 2.5 | 12.0 | 8.0 | 23 | 11 | 0 | 35 | 7.99 |
| COMPARATIVE EXAMPLE 8 | 2.5 | 12.0 | 6.0 | 18 | 12 | 0 | 30 | 8.30 |
| COMPARATIVE EXAMPLE 9 | 2.5 | 12.0 | 3.0 | 10 | 12 | 0 | 22 | 8.46 |
| COMPARATIVE EXAMPLE 10 | 2.5 | 9.0 | 2.0 | 6 | 9 | 0 | 15 | 8.35 |
| COMPARATIVE EXAMPLE 11 | 2.5 | 10.0 | 3.0 | 10 | 10 | 0 | 20 | 8.32 |
| COMPARATIVE EXAMPLE 12 | 2.5 | 11.0 | 4.0 | 13 | 11 | 0 | 23 | 8.40 |
| COMPARATIVE EXAMPLE 13 | 2.0 | 6.0 | 3.0 | 10 | 6 | 0 | 16 | 8.03 |
| COMPARATIVE EXAMPLE 14 | 1.5 | 4.5 | 3.5 | 11 | 5 | 0 | 16 | 7.94 |
| COMPARATIVE EXAMPLE 15 | 2 | 7 | 2.5 | 8 | 7 | 0 | 15 | 8.15 |

FIG. 1 shows combinations of the content of W and the content of V in Examples 1 to 32 and Comparative 2. VC and WC denote the MC type carbides that are important carbides for improving the Young's modulus.

$M_6C$ denotes a carbide formed by bonding six metallic atoms (at least one of W, Fe and Mn) and one carbon atom, which has substantially no effect on improving the Young's modulus. The methods for measuring these values are as follow.

Volume Ratio of Carbide

The volume ratio was measured using an X-ray diffraction apparatus (RINT-2000 made by RIGAKU Co.).

Specific Gravity

The specific gravity was calculated based on the Archimedean principle. The weight of a sample piece was first measured in the air. Then, the weight of a vessel filled with water, and the weight of the same vessel when the sample piece was suspended in water were measured to determine the weight difference between the two measurements. The weight difference when the sample piece was suspended in water in the vessel is equal to the buoyancy applied to the sample piece, and the buoyancy is equal to the weight of water excluded by the sample piece. Therefore, the volume of the sample piece can be determined from the weight difference and density of water. The specific gravity of the sample piece is obtainable from the volume and weight of the sample in the air.

According to the results of measurements in Tables 1 and 2, carbides other than the MC type carbides are suppressed from being formed in the present invention while controlling the volume ratio and specific gravity of the MC type carbide in the ranges of 17 to 32% and less than 8.3, respectively. Accordingly, it may be conjectured that characteristics such as the Young's modulus, toughness and ductility can be maintained at high levels while reducing the specific gravity. In the Comparative Examples, in contrast to Examples of the present invention, on the other hand, carbides other than the MC type carbide may be formed, the volume ratio of the MC type carbide may be out of the range described above, or the specific gravity may exceed 8.3, thereby failing to attain the object of the present invention.

Figure 3:
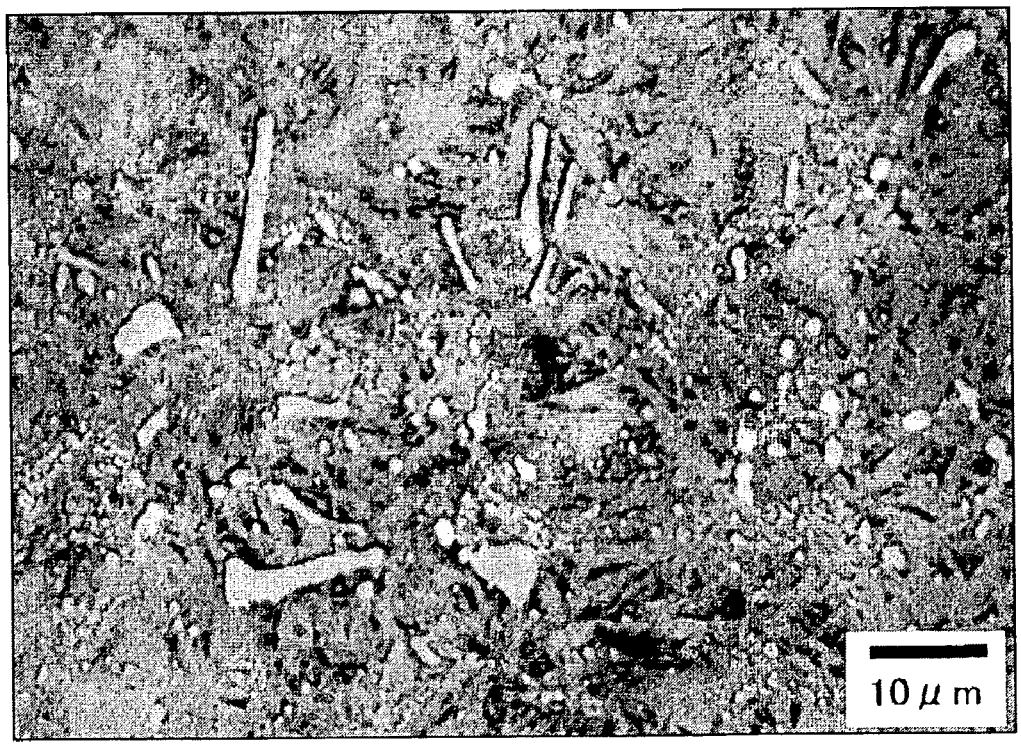
FIG. 3 is a photomicrograph of the metallic matrix of the iron-based alloy according to the present invention.

FIG. 3 is a photomicrograph showing the metallic matrix of the iron-based alloy of Example 9. According to this photograph, the base matrix comprises the tempered martensite matrix that is tempered by the second heat treatment after transforming into the martensite phase by the first heat treatment, and the austenite phase. Carbides are distributed among these phases. The relatively large and slender carbide mainly comprises VC, and the relatively small carbide corresponds to WC. The portions where grain boundaries are very fine and not clear correspond to the austenite phase. Since the austenite phase is precipitated from the base matrix during the cooling in the second heat treatment, the austenite phase has a relatively high viscosity because it is precipitated under a condition with a small C content.

(2) Strength Test

The raw materials of the iron-based alloys having the compositions in Examples 33 to 37 and in Comparative Example 16 shown in Table 3 were melted, cast and rolled as in Examples 1 to 32, and rod-shaped samples with a diameter of 20 mm were obtained. These samples were cut to form test pieces having an approximately predetermined shape. Then, the test pieces in Examples 33 to 37 were heat treated as in Examples 1 to 32, while the test piece in Comparative Example 16 was subjected to a usual carburizing treatment (tempering at a low temperature after hardening under a carburizing atmosphere).

TABLE 3

| | C | Si | Mn | P | S | Ni | V | W | Ti | Nb | B | Cr | Mo |
|---|---|---|---|---|---|---|---|---|---|---|---|---|---|
| EXAMPLE 33 | 1.7 | 0 | 1.2 | 0.01 | 0 | 1.2 | 5.4 | 5.4 | 0.3 | — | — | — | — |
| EXAMPLE 34 | 1.6 | 0.1 | 0.5 | 0.01 | 0.001 | 2.2 | 5 | 5 | — | — | — | — | — |
| EXAMPLE 35 | 2.5 | 0.2 | 0.5 | 0.01 | 0.001 | 2 | 7.7 | 8.1 | — | — | — | — | — |
| EXAMPLE 36 | 1.6 | 0 | 0.4 | 0.01 | 0.001 | 2.3 | 5.1 | 5.2 | — | — | — | 1.1 | 0.5 |
| EXAMPLE 37 | 1.6 | 0 | 0.4 | 0.01 | 0.001 | 2.1 | 5.2 | 5.1 | — | 0.6 | 0 | — | — |
| COMPARATIVE EXAMPLE 16 | 0.2 | 0.2 | 0.8 | 0.01 | 0.002 | 0.1 | — | — | — | — | — | 1.1 | 0.2 |

(Unit: wt %)

Subsequently, each sample in Examples 33 to 37 and in Comparative Example 16 was formed into each sample piece by applying finish cutting, and mechanical properties such as the Young's modulus, fatigue strength, tensile strength and 2% proof stress were investigated. The method for measuring each property was as follows:

Young's Modulus

A ultrasonic method was used. The test piece was exposed to ultrasonic waves, and the velocities of the longitudinal wave and transverse wave were measured from respective reflection times. The Young's modulus was calculated from respective wave velocities and specific gravity.

Fatigue Strength

An Ono type rotary bending fatigue meter (FTO-10H made by Tokyo Test Equipment Manufacturing Co.) was used for the measurement.

Tensile Strength and 0.2% Proof Stress

The load was measured with a load cell and elongation was measured with a distortion gauge using a tensile tester (AG-5000C made by Shimadz Co.).

The result of these measurements are shown in Table 4.

TABLE 4

| | YOUNG'S MODULUS (GPa) | FATIGUE STRENGTH (MPa) | TENSILE STRENGTH (MPa) | 0.2% PROOF STRESS (MPa) |
|---|---|---|---|---|
| EXAMPLE 33 | 242 | 735 | 1957 | 1902 |
| EXAMPLE 34 | 260 | 740 | 1980 | 1920 |
| EXAMPLE 35 | 285 | 760 | 2050 | 1990 |
| EXAMPLE 36 | 260 | 800 | 2100 | 2030 |
| EXAMPLE 37 | 260 | 750 | 1960 | 1900 |
| COMPARATIVE EXAMPLE 16 | 200 | 600 | 1275 | 1000 |

Table 4 clearly shows that the iron-based alloys in the Examples of the present invention are excellent in mechanical characteristics as compared with those in the Comparative Examples, although the specific gravity of the former is comparable with that of the iron-based alloy in the Comparative Examples, confirming that the objects of making the articles lightweight and compact can be attained.

According to the present invention as hitherto described, high levels of the Young's modulus, toughness and ductility can be assured without adding any reinforce particles. In addition, since the specific gravity is suppressed from increasing while assuring these characteristics, the iron-based alloy according to the present invention is promising as a material for making articles lightweight and compact.

The invention claimed is:

1. An iron-based alloy consisting of: 1.5 to 2.5 wt % of C; 0.25 to 4.75 wt % of Ni; W and V in quantities corresponding to a region surrounded by a line L as shown in FIG. 1 of attached drawings; 0.25 to 1.7 wt % of Mn, at least one of 0.3 wt % or less of Ti, 0.6 wt % or less of Nb, 10 wt % or less of Mo and 0.005 wt % or less of B; a balances of Fe; inevitable impurities; and an MC carbide included in a matrix comprising a martensitic phase and an austenitic phase, wherein the austentic phase is a low carbon content austenite phase.

2. A method for producing an iron-based alloy comprising:

a first treatment for applying a solid solution treatment by heating the iron-based alloy to a temperature of an austentite forming temperature or more, and then rapidly cooling the iron-based alloy from the temperature of the austenite forming temperature or more to consequently obtain a mixed matrix comprising a base matrix of martensite and remaining austenite phases and a non-molten carbide; and a second treatment of precipitating an MC carbide within an eutectoid transformation temperature range to consequently precipitate a low carbon content austenite phase followed by cooling, wherein the iron-based alloy consists of: 1.5 to 2.5 wt % of C; 0.25 to 4.75 wt % of Ni; W and V in quantities corresponding to a region surrounded by a line L as shown in FIG. 1 of attached drawings, 0.25 to 1.7 wt % of Mn, at least one of 0.3 wt % or less of Ti, 0.6 wt % or less of Nb, 10 wt % or less of Mo and 0.005 wt % or less of B; a balance of Fe; and inevitable impurities.

3. A method for producing an iron-based alloy comprising:

solid solution treating an iron-based alloy by heating at the austenitic-forming temperature or higher followed by rapid cooling to produce an iron-based alloy having a mixed matrix comprising a martensitic base with the remaining being austenitic and non-molten carbides; and tempering by heating iron-based alloy at the eutectoid transformation temperature (A1 transformation temperature) for an effective amount of time to precipitate MC carbides and consequently forming low-carbon austenitic phase with a tempered martensitic based matrix followed by cooling, wherein the iron-based alloy consists of: 1.5 to 2.5 wt % of C; 0.25 to 4.75 wt % of Ni; W and V in quantities corresponding to a region surrounded by a line L as shown in FIG. 1 of attached drawings; 0.25 to 1.7 wt % of Mn, at least one of 0.3 wt % or less of Ti, 0.6 wt % or less of Nb, 10 wt % or less of Mo and 0.005 wt % or less of B; a balance of Fe; and inevitable impurities.

* * * * *